US010608383B2

(12) United States Patent
Kumamoto et al.

(10) Patent No.: US 10,608,383 B2
(45) Date of Patent: Mar. 31, 2020

(54) ELECTRICAL CONNECTOR SHIELD WITH GAP SHIELDING

(71) Applicant: Tyco Electronics Japan G.K., Kanagawa (JP)

(72) Inventors: Tadashi Kumamoto, Kanagawa (JP); Kazuhiro Mizukami, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 16/108,679

(22) Filed: Aug. 22, 2018

(65) Prior Publication Data

US 2019/0067882 A1 Feb. 28, 2019

(30) Foreign Application Priority Data

Aug. 23, 2017 (JP) ..... 2017-160147

(51) Int. Cl.

| | |
|---|---|
| ***H01R 12/70*** | (2011.01) |
| ***H01R 13/518*** | (2006.01) |
| ***H01R 13/6581*** | (2011.01) |
| ***H01R 13/6593*** | (2011.01) |
| ***H01R 13/639*** | (2006.01) |
| ***H01R 13/506*** | (2006.01) |

(Continued)

(52) U.S. Cl.

CPC ..... *H01R 13/6593* (2013.01); *H01R 12/7005* (2013.01); *H01R 13/506* (2013.01); *H01R 13/518* (2013.01); *H01R 13/639* (2013.01); *H01R 13/6581* (2013.01); *H01R 13/6582* (2013.01); *H01R 24/62* (2013.01)

(58) Field of Classification Search

CPC .. H01R 13/6581; H01R 13/40; H01R 13/422; H01R 13/4223; H01R 13/424; H01R 13/426; H01R 13/516; H01R 13/627; H01R 13/6271–6273; H01R 12/7005; H01R 43/20

See application file for complete search history.

(56) References Cited

U.S. PATENT DOCUMENTS

| | | | | |
|---|---|---|---|---|
| 7,229,317 | B2 * | 6/2007 | Togami | G02B 6/4277 439/607.2 |
| 8,840,435 | B2 * | 9/2014 | Plazio | H01R 13/506 439/607.41 |
| 2017/0352992 | A1 | 12/2017 | Lin et al. | |

FOREIGN PATENT DOCUMENTS

| | | | |
|---|---|---|---|
| CN | 205944619 | U | 2/2017 |
| EP | 2034564 | A2 | 3/2009 |
| JP | 2010-182647 | A | 8/2010 |

(Continued)

OTHER PUBLICATIONS

Extended European Search Report, European Patent No. 18190077.0, dated Jan. 15, 2019, 10 pages.

(Continued)

*Primary Examiner* — Vanessa Girardi
(74) *Attorney, Agent, or Firm* — Barley Snyder

(57) ABSTRACT

A shielded connector comprises an inner housing accommodating a contact and a shield shell surrounding the inner housing. The inner housing has a catch protrusion. The shield shell has a shell main body formed with an opening extending through the shield shell and a cover tab supported by the shell main body. The catch protrusion is inserted from an inside of the shield shell into the opening and the cover tab covers the opening while being set back from the catch protrusion toward an outside of the shield shell.

15 Claims, 7 Drawing Sheets

(51) Int. Cl.
*H01R 13/6582* (2011.01)
*H01R 24/62* (2011.01)

(56) References Cited

FOREIGN PATENT DOCUMENTS

| | | | |
|---|---|---|---|
| JP | 2011-60613 | A | 3/2011 |
| WO | 2016125668 | A1 | 8/2016 |

OTHER PUBLICATIONS

English translation of JP 2010-182647A, dated Aug. 19, 2010, 37 pages.

* cited by examiner

ELECTRICAL CONNECTOR SHIELD WITH GAP SHIELDING

CROSS-REFERENCE TO RELATED APPLICATION

This application claims the benefit of the filing date under 35 U.S.C. § 119(a)-(d) of Japanese Patent Application No. 2017-160147, filed on Aug. 23, 2017.

FIELD OF THE INVENTION

The present invention relates to an electrical connector and, more particularly, to an electrical connector having an electromagnetic shielding function.

BACKGROUND

In order to suppress electromagnetic noise emission from a device to the outside and/or the influence of electromagnetic noise received from another device, an electrical connector has an electromagnetic shield shell or outer conductor surrounding an inner conductor. Such an electrical connector is disclosed in Japanese Patent Application No. 2011-60613A, which describes a shielded connector provided with an inner conductor connected to an electrical wire, an inner insulator accommodating the inner conductor, an outer conductor surrounding the inner insulator, and an outer insulator provided outside the outer conductor.

By providing a window penetrating the shield shell along the wall thickness, and having a lance of an insulator adapted to catch in the window, the shield shell can be retained to the insulators. However, the electromagnetic shielding performance can be degraded due to the window acting as a gap in the electromagnetic shield. The shielded connector of JP 2011-60613A, by contrast, does not have the window for improved electromagnetic shielding, but has difficulty in retaining the outer conductor to the inner insulator and/or the outer insulator because the outer conductor does not have the window.

SUMMARY

A shielded connector comprises an inner housing accommodating a contact and a shield shell surrounding the inner housing. The inner housing has a catch protrusion. The shield shell has a shell main body formed with an opening extending through the shield shell and a cover tab supported by the shell main body. The catch protrusion is inserted from an inside of the shield shell into the opening and the cover tab covers the opening while being set back from the catch protrusion toward an outside of the shield shell.

BRIEF DESCRIPTION OF THE DRAWINGS

The invention will now be described by way of example with reference to the accompanying Figures, of which.

DETAILED DESCRIPTION OF THE EMBODIMENT(S)

Figure 1A:
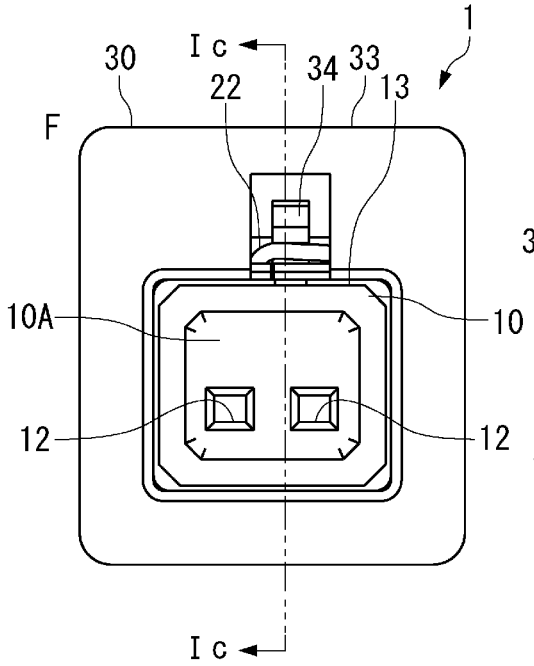
FIG. 1A is a front view of a shielded connector according to an embodiment.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A connector 1 according to an embodiment is shown in FIGS. 1A-5B. The connector 1 is a shielded connector having an electromagnetic shielding function. In an embodiment, the connector 1 is used in an on-board device for vehicle. The electromagnetic shielding function of the connector 1 can suppress electromagnetic noise emission to the outside from the device and/or the influence of electromagnetic noise received from another device. The connector 1 is to be mated with a mating connector connected to a board or the like of the device along an axial line A of the connector 1 shown in FIG. 1C. Hereinafter, "around the axis" refers to around the axial line A.

Figure 1B:
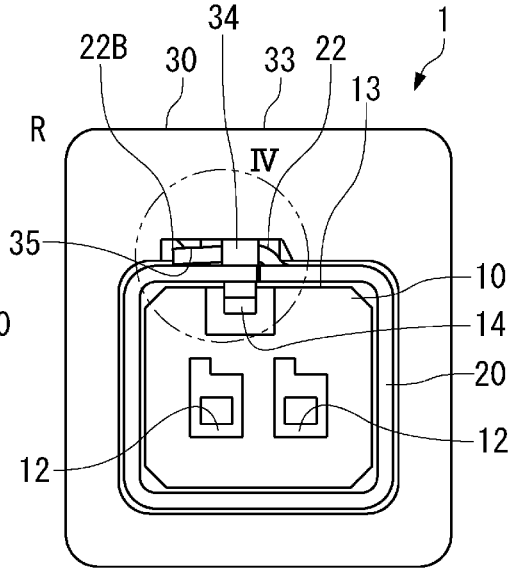
FIG. 1B is a rear view of the shielded connector of FIG. 1A.
Figure 1C:
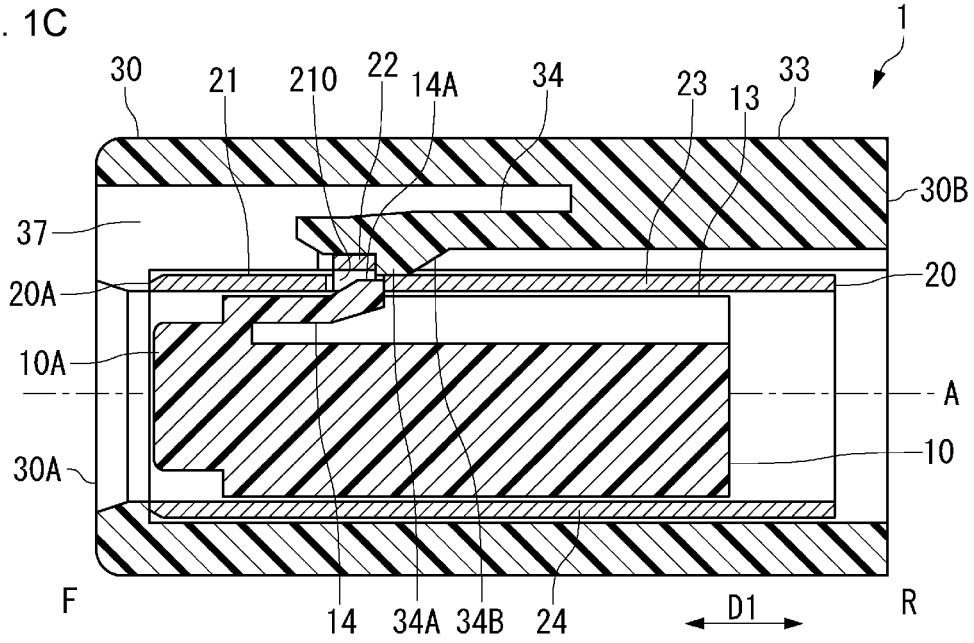
FIG. 1C is a sectional side view of the shielded connector taken along line Ic-Ic of FIG. 1A.
Figure 2:
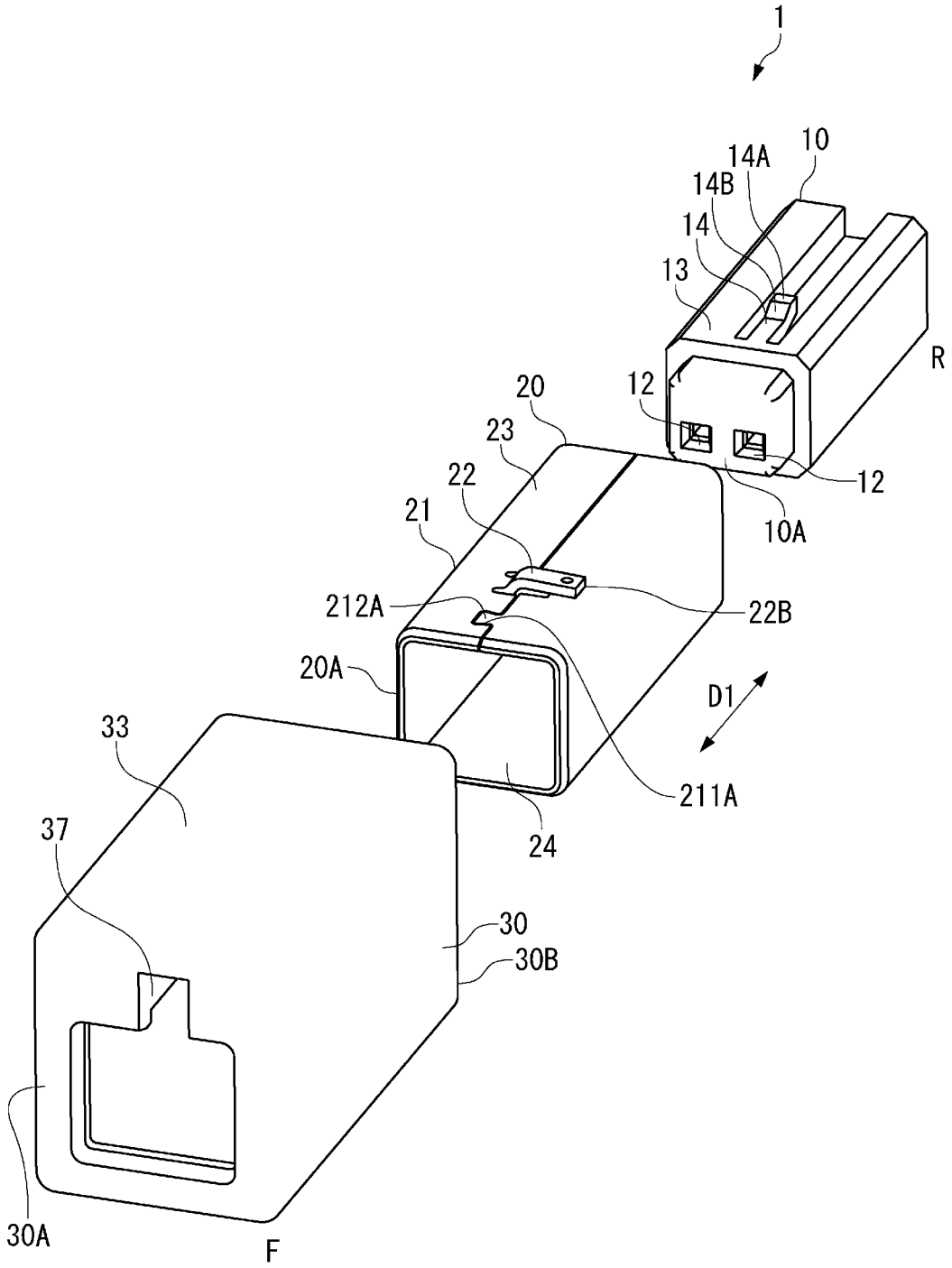
FIG. 2 is an exploded perspective view of the shielded connector of FIG. 1A.

The connector 1, as shown in FIGS. 1A-2, has an inner housing 10 that is an insulator, a shield shell 20 that is a conductor, and an outer housing 30 that is an insulator. The inner housing 10 is surrounded by the shield shell 20 around the axis A. The shield shell 20 is surrounded by the outer housing 30 around the axis A.

In the embodiment shown in FIGS. 1A-2, the inner housing 10 is formed from a resin material having an insulation property by injection molding in a substantially rectangular-parallelepiped-like shape having four walls around the axis A. Cavities 12, 12 accommodating a pair of contacts therein are formed in the inner housing 10, as shown in FIG. 2. In the shown embodiment, the inner housing 10 retains a pair of conductive contacts. In other embodiments, the connector 1 may have only one contact or more than two contacts and a corresponding number of cavities 12.

The mating connector is to be mated to a front end portion 10A of the inner housing 10 shown in FIGS. 1A-2. In each of the drawings, a front end side of the connector 1 is denoted by F, and a rear end side of the connector 1 is denoted by R. The cavities 12, 12 penetrate the inner housing 10 in a direction of plugging/extraction of the connector 1 into/from the mating connector. Electrical wires connected via crimping portions of the contacts are each led out to the rear sides of the cavities 12, 12. In the connector 1, a central portion adjacent the axial line A where the contacts are located is referred to as "inside", and an outer-peripheral portion distant from the axial line A in a direction perpendicular to the axial line A is referred to as "outside".

As shown in FIGS. 1B, 1C, and 2, a catch beam 14 caught by a portion of the shield shell 20 is provided on a sidewall 13 of the inner housing 10. The catch beam 14 is supported in the vicinity of the front end portion 10A of the inner housing 10, and extends to the rear side R. A catch protrusion 14A protruding toward the outside is formed at a free end portion of the catch beam 14. A front end 14B of the catch protrusion 14A is inclined relative to an axial-line direction D1, as shown in FIG. 4B, such that the catch beam 14 can be deflected by a small force when the inner housing 10 is inserted into the shield shell 20 from the rear side. A rear end 14C of the catch protrusion 14A rises substantially perpendicularly to the axial-line direction D1.

The shield shell 20, as shown in FIGS. 2 and 3, surrounds the outside of the inner housing 10 retaining the contacts. The shield shell 20 is grounded to the electrical wires connected to the contacts retained by the inner housing 10, and to a casing of the device provided with the mating connector. The shield shell 20 imparts an electromagnetic shielding function to the connector 1.

The shield shell 20, as shown in FIGS. 1A-3, integrally has a shell main body 21 and a cover tab 22 supported by the shell main body 21, and is made from a material having conductivity and elasticity. The shield shell 20 of the present embodiment is so formed as to be rectangular in cross section by stamping out a sheet material formed from a metal material along the wall thickness and bending it into a rectangular-tube-like shape.

Figure 3A:
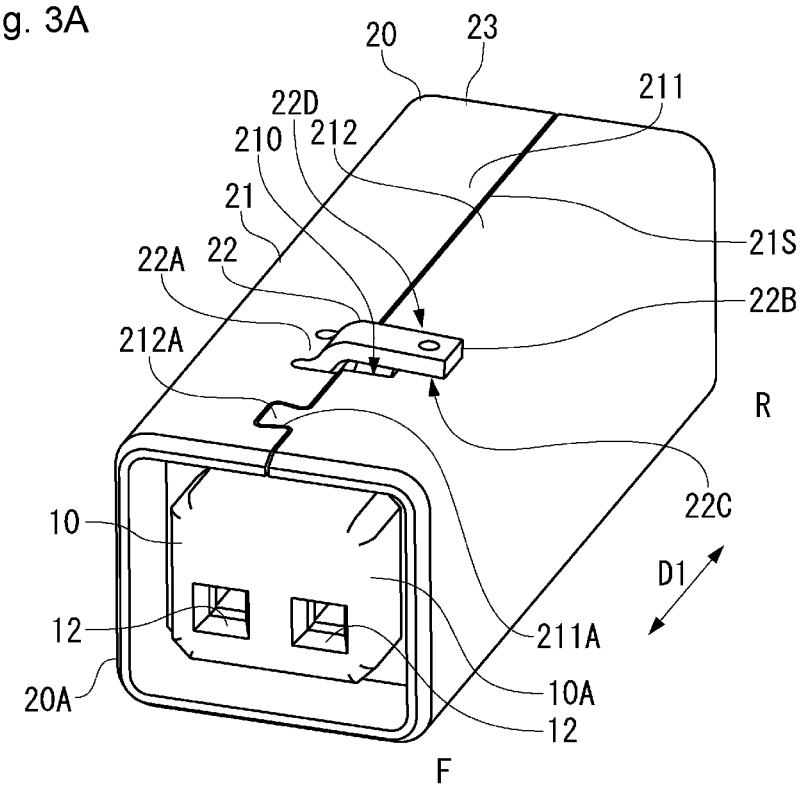
FIG. 3A is a perspective view of an inner housing and a shield shell of the shielded connector of FIG. 1A.

As shown in FIG. 3A, an opening 210 penetrating the shield shell 20 in a direction from the inside/outside toward the outside/inside is formed in the shell main body 21. A dimension from a sidewall 23 of the shell main body 21 where the opening 210 is located to an opposite sidewall 24 is set such that the catch beam 14 is pressed toward the inside and deflected by the sidewall 23 of the shell main body 21 when the inner housing 10 is inserted into the shield shell 20 in an axial-line direction D1 of the axial line A from the rear side of the shield shell 20.

As shown in FIG. 1C, once the inner housing 10 is inserted to the front end 20A of the shield shell 20, the catch protrusion 14A is inserted into the opening 210 from the inside. As shown in FIG. 4B, the rear end 14C of the catch protrusion 14A is caught by a rear end edge of the opening 210 opposite the rear end 14C. Then, the catch beam 14 retains the shield shell 20 to the inner housing 10.

The rectangular-tube-like shell main body 21, as shown in FIG. 3A, has a seam 21S along the axial-line direction D1. The seam 21S is located at a widthwise center of the sidewall 23 of the shell main body 21. The shell main body 21 is formed in a tubular shape such that end faces of a first end portion 211 and a second end portion 212 of the sheet material abut on each other at the seam 21S. A tongue 212A protruding from the second end portion 212 fits in a notch 211A of the first end portion 211, thereby preventing the first end portion 211 and the second end portion 212 from being separated.

The opening 210 is formed in a substantially rectangular shape as a whole by combining a notch formed in the first end portion 211 by cutting and bending the cover tab 22 and a notch formed in the second end portion 212. The cover tab 22 electromagnetically closes the opening 210 so that a gap of the electromagnetic shield does not occur at the position of the opening 210 penetrating the shield shell 20. The cover tab 22 is not located inside the opening 210, but offset toward the outside from the opening 210.

Figure 3B:
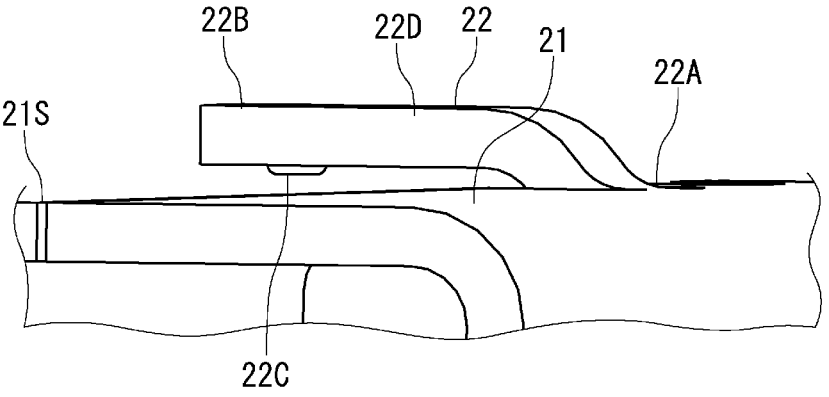
FIG. 3B is a perspective view of a cover tab of the shield shell of FIG. 3A.

The cover tab 22, as shown in FIGS. 2, 3A, and 3B, is supported by the shell main body 21 in a cantilever-like manner by cutting and bending a portion of the sheet material forming the shield shell 20. Since being cut and bent toward the outside from the shell main body 21, the cover tab 22 covers the opening 210 from the outside while being set back from the catch protrusion 14A inserted into the opening 210 of the shell main body 21. The cover tab 22 integrally extends into the first end portion 211 of the shell main body 21 and extends in a direction perpendicular to the axial-line direction D1 of the shell main body 21 in the outside over the opening 210. A distal end portion of the cover tab 22 reaches the sidewall 23 beyond the opening 210. The cover tab 22 is formed in a rectangular shape as viewed from above.

Figure 4A:
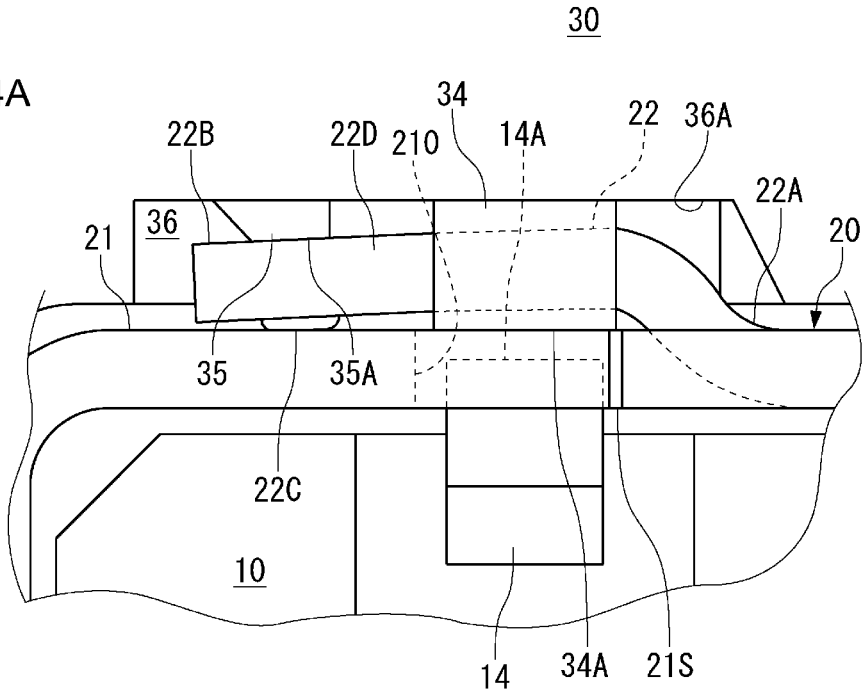
FIG. 4A is a rear view of a portion IV of the shielded connector of FIG. 1B.
Figure 4B:
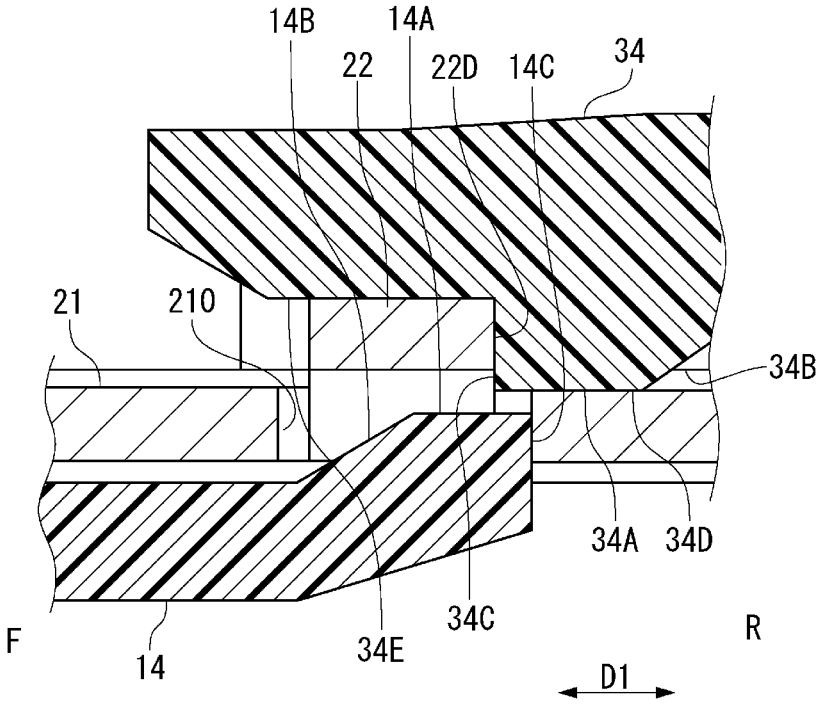
FIG. 4B is a sectional side view of a portion of the shielded connector of FIG. 1C.

As shown in FIGS. 3A, 3B, and 4A, the cover tab 22 has a supported end portion 22A rising toward the outside from the shell main body 21 and a free end portion 22B extending substantially along the sidewall 23 from the supported end portion 22A. A contact portion 22C protruding toward the sidewall 23 of the shell main body 21 is formed in the vicinity of a distal end of the free end portion 22B. The contact portion 22C is raised out by pressing from an outer side of the cover tab 22, thus being so formed as to protrude toward the inside. The cover tab 22 covers the opening 210 from the outside with the catch protrusion 14A being caught in the opening 210. Although being separated from the surface of the shell main body 21 in an unloaded state shown in FIG. 3B, once the outer housing 30 is assembled onto the shield shell 20, the contact portion 22C of the free end portion 22B comes into contact with the shell main body 21, as shown in FIG. 4A, to establish electrical continuity.

The outer housing 30, as shown in FIG. 1C, surrounds the shield shell 20 from the outside. When the shield shell 20 is inserted from the rear side of the outer housing 30 to a front end of an accommodation space formed inside the outer housing 30, the cover tab 22 held between the outer housing 30 and the shell main body 21 is pressed by a portion of the outer housing 30 and thus deflected toward the inside. Then, the contact portion 22C of the free end portion 22B of the cover tab 22 comes into contact with the shell main body 21, as shown in FIG. 4A, to establish electrical continuity. In another embodiment, instead of the cover tab 22 being provided with the contact portion 22C, the shell main body 21 may be provided with a contact portion protruding toward an inner side of the free end portion 22B of the cover tab 22.

The outer housing 30 is so formed from a resin material having an insulation property by injection molding as to have the appearance of a rectangular parallelepiped having sidewalls each corresponding to four sidewalls of the shell main body 21. In various embodiments, the outer housing 30 may be formed from a resin or metal having conductivity. A catch beam 34 caught by the cover tab 22 of the shield shell 20 is provided on an inner side of one sidewall 33 of the outer housing 30, as shown in FIGS. 4A and 4B. The catch beam 34 is caught by the cover tab 22 nearer the supported end portion 22A than a portion of the cover tab 22 pressed toward the shell main body 21 by a portion of the outer housing 30.

The catch beam 34, as shown in FIGS. 1C, 4A, and 4B, extends from the rear side toward the front side. A catch protrusion 34A protruding toward the inside is formed at a free-end side of the catch beam 34. As shown in FIG. 1C, the catch protrusion 34A is caught by the cover tab 22 from behind. In order that the catch beam 34 can be deflected by a small force when the shield shell 20 is inserted into the outer housing 30 from the rear side, a rear end 34B of the catch protrusion 34A is inclined relative to the axial-line direction D1 as shown in FIG. 4B. On the other hand, a front end 34C of the catch protrusion 34A rises substantially perpendicularly to the axial-line direction D1.

Figure 5A:
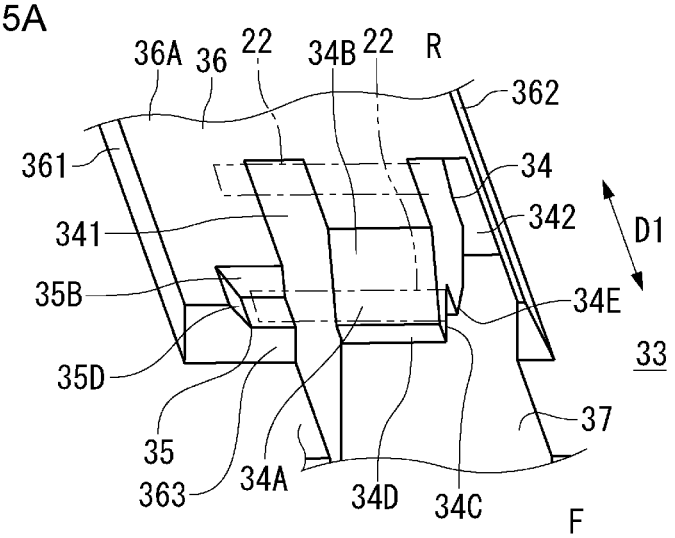
FIG. 5A is a perspective view of an inside of an outer housing of the shielded connector of FIG. 1A.
Figure 5B:
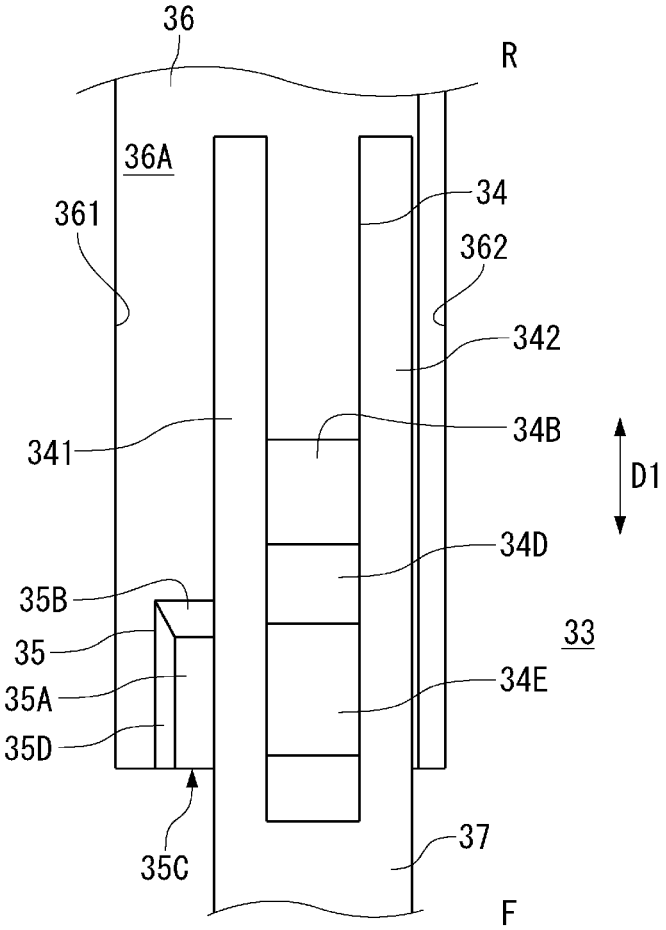
FIG. 5B is a bottom view of the inside of the outer housing of FIG. 5A.

The catch beam 34 and a pressing protrusion 35 for pressing the free end portion 22B of the cover tab 22 are shown in FIGS. 5A and 5B. The catch beam 34 and the pressing protrusion 35 are formed inside a guide groove 36 extending in the axial-line direction D1 of the shield shell 20 on the bottom side of the sidewall 33 of the outer housing 30. The guide groove 36 is depressed toward the outside from the bottom side of the sidewall 33, and receives the cover tab 22 rising from the shell main body 21 from the rear side R. As the shield shell 20 is being inserted into the outer housing 30 in the axial-line direction D1, the cover tab 22 is shifted inside the guide groove 36 from a position indicated by a chain line to a position indicated by a chain double-dashed line in FIG. 5A.

The catch beam 34 and the pressing protrusion 35 are formed between inner walls 361, 362 extending along the axial-line direction D1 in the guide groove 36, as shown in FIGS. 5A and 5B. The inner walls 361, 362 extend to a rear end 30B of the outer housing 30. The catch beam 34 is defined inside the inner walls 361, 362 of the guide groove 36 by grooves 341, 341 recessed from the bottom portion 36A of the guide groove 36. The catch protrusion 34A of the catch beam 34 protrudes toward the inside beyond an inner face of the sidewall 33 around the guide groove 36. In order that the catch protrusion 34A can be extracted from a mold in the axial-line direction D1 at the time of injection molding, a groove 37, shown in FIGS. 1C and 2, is formed extending into a front end 30A of the outer housing 30 beyond a front wall 363 of the guide groove 36.

As shown in FIGS. 5A and 5B, the pressing protrusion 35 protrudes toward the inside from the bottom portion 36A of the guide groove 36 in a position corresponding to the free end portion 22B of the cover tab 22. The pressing protrusion 35 is located beside the catch protrusion 34A. One side face of the pressing protrusion 35 extends flush with a wall face of the groove 341.

The pressing protrusion 35, as shown in FIGS. 5A and 5B, has a flat apex portion 35A substantially parallel to the sidewall 23 of the shell main body 21. The apex portion 35A is so formed in a position corresponding to the contact portion 22C of the cover tab 22 as to have a size corresponding to the contact portion 22C. In order that a sufficient rigidity to press the contact portion 22C can be imparted to the pressing protrusion 35, a side face 35D of the pressing protrusion 35 expands from the apex portion 35A to the bottom portion 36A of the guide groove 36. Like the catch protrusion 34A, a rear end 35B of the pressing protrusion 35 is inclined relative to the axial-line direction D1, and a front end 35C of the pressing protrusion 35 extends substantially perpendicularly to the axial-line direction D1.

The apex portion 35A of the pressing protrusion 35 remains inside the guide groove 36, as shown in FIG. 4A. As a result of a dimensional relation between the shield shell 20 and the outer housing 30 when the shield shell 20 and the outer housing 30 are assembled together, inside the guide groove 36, the free end portion 22B of the cover tab 22 is pressed inwardly toward the shell main body 21 by the apex portion 35A.

When the shield shell 20 is inserted into the outer housing 30, the cover tab 22 is guided in the axial-line direction D1 by the inner walls 361, 362 of the guide groove 36 from the rear end 30B of the outer housing 30. As the shield shell 20 is being inserted to the front end of the accommodating space inside the outer housing 30, the cover tab 22 moves over the catch protrusion 34A from the rear side toward the front side, while deflecting the catch beam 34 toward the outside, to be disposed in the position indicated by the chain double-dashed line in FIG. 5A.

As shown in FIG. 4B, the front end 34C of the catch protrusion 34A is caught by the rear end 22D of the cover tab 22. Therefore, the catch beam 34 retains the shield shell 20 to the outer housing 30, and simultaneously the free end portion 22B of the cover tab 22 is pressed between the pressing protrusion 35 and the shell main body 21, which causes the contact portion 22C to come into contact with the shell main body 21 to establish electrical continuity. Since the pressing protrusion 35 presses the cover tab 22 to the shell main body 21, a sufficient contact pressure is secured between the cover tab 22 and the shell main body 21.

The catch protrusion 14A of the inner housing 10, as shown in FIG. 1C and FIG. 4A, is located inside the opening 210. Therefore, even when the shield shell 20 and the inner housing 10 is assembled together in advance, the catch protrusion 14A of the inner housing 10 and the catch protrusion 34A of the outer housing 30 do not interfere with each other.

As shown in FIG. 4B, an apex portion 34D of the catch protrusion 34A is in contact with the surface of the shell main body 21 and a distal end portion 34E of the catch beam 34 be in contact with the surface of the cover tab 22 because this causes the catch beam 34 to stably retain the shield shell 20 to the outer housing 30.

The cover tab 22 of the shield shell 20 covers the opening 210 while being set back from the catch protrusion 14A of the inner housing 10 toward the outside. Therefore, regardless of the opening 210 formed in the shield shell 20, electromagnetic noise entry and/or emission through the opening 210 can be avoided. The electromagnetic shielding performance of the connector 1 is improved while a structure for retaining the shield shell 20 to the inner housing 10 by inserting the catch protrusion 14A into the opening 210 is maintained. Then, electromagnetic noise contamination of the devices provided with the connector 1 and the mating connector or the like and/or of signals transmitted through the electrical wires is avoided, and thus the reliability of communication can be improved.

The cover tab 22, by not only covering the opening 210 but also catching the catch protrusion 34A of the outer housing 30, also functions to retain the shield shell 20 to the outer housing 30. Moreover, since the free end portion 22B of the cover tab 22 pressed between the outer housing 30 and the shell main body 21 comes into contact with the shell main body 21 to establish electrical continuity, electromagnetic noise entry into the cover tab 22 and/or electromagnetic noise emission from the cover tab 22 can be avoided. As shown in FIG. 4A, the cover tab 22 is set back from the catch protrusion 14A toward the outside, and rises from the shell main body 21 by a dimension slightly larger than the wall thickness to the extent necessary to catch the catch protrusion 34A. Then, the free end portion 22B is pressed by the pressing protrusion 35 of the outer housing 30, and thus brought into contact with the shell main body 21. Accordingly, the cover tab 22 extends along the shell main body 21 as a whole, and both end sides of the cover tab 22 are electrically connected to the shell main body 21, so that the cover tab 22 is substantially integrally coupled with the shell main body 21 electromagnetically.

According to the present embodiment, a region discontinuous from the shell main body 21 is limited to a distal-end side from the contact portion 22C of the cover tab 22, so that the cover tab 22 itself can avoid becoming a source of emission and/or a source of reception of electromagnetic noise as much as possible.

A connector 2 according to another embodiment is shown in FIGS. 6A-7B. The connector 2, like the connector 1, comprises the inner housing 10, the shield shell 20, and the outer housing 30.

Figure 6A:
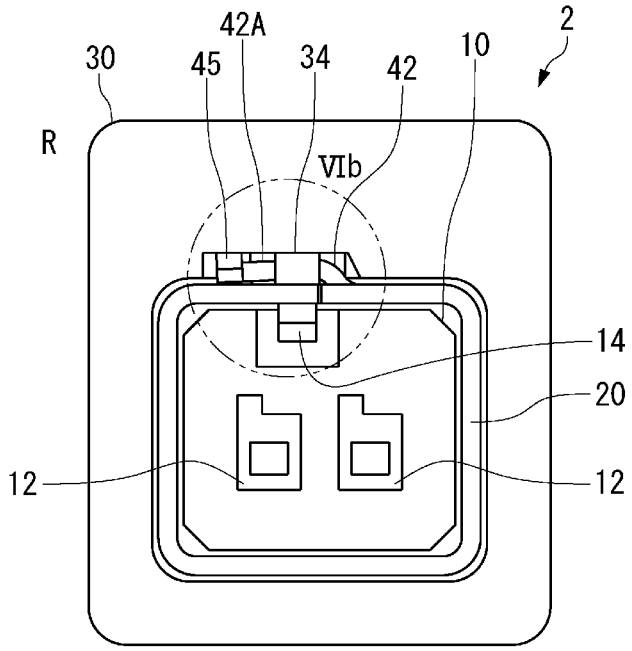
FIG. 6A is a rear view of a shielded connector according to another embodiment.
Figure 6B:
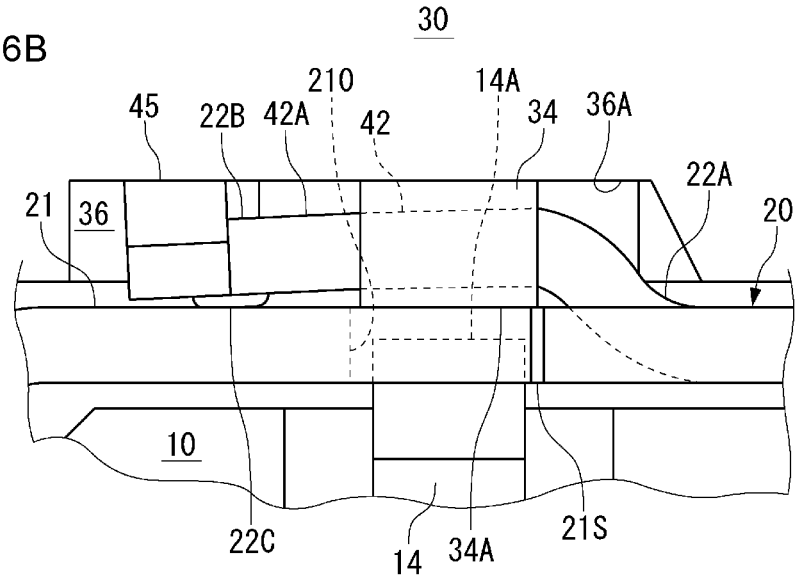
FIG. 6B is a rear view of a portion VIb of the shielded connector of FIG. 6A.
Figure 7A:
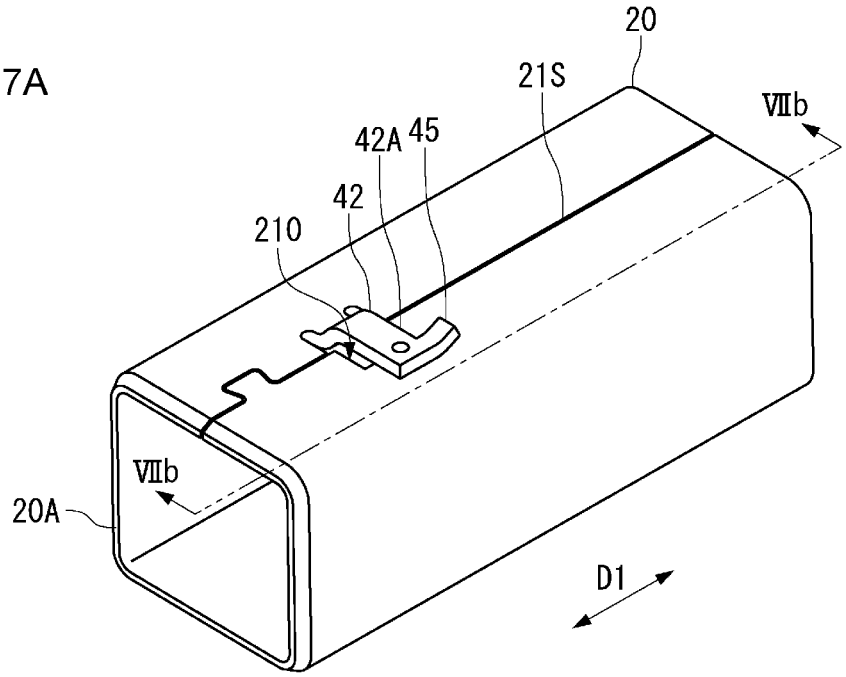
FIG. 7A is a perspective view of a shield shell of the shielded connector of FIG. 6A.

A cover tab 42 of the shield shell 20 is supported by the shell main body 21 in a cantilever-like manner, as shown in FIG. 7A, and has at a free end portion a pressed protrusion 45 protruding toward the outside from a portion covering the opening 210 from the outside. As shown in FIG. 6B, the pressing protrusion 35 is not formed on the outer housing 30 in the connector 2. A portion adjacent to the catch beam 34 in the bottom portion 36A of the guide groove 36, namely, a portion where the pressing protrusion 35 might have been formed, is flatly formed.

A cover portion 42A, which is the portion of the cover tab 42 covering the opening 210 from the outside as shown in FIG. 7A, is configured in a similar manner to the cover tab 22 of the connector 1. The cover tab 42 is composed of the cover portion 42A and the pressed protrusion 45. The pressed protrusion 45 is stamped from the sheet material of the shield shell 20 integrally with the cover portion 42A, and bent in an out-of-plane direction relative to the cover portion 42A. The pressed protrusion 45 extends in a direction perpendicular to the cover portion 42A, while gradually rising toward the outside, from a distal end portion (free end portion) of the cover portion 42A. The cover portion 42A extends in the direction perpendicular to the axial-line direction D1, whereas the pressed protrusion 45 extends in the axial-line direction D1.

Figure 7B:
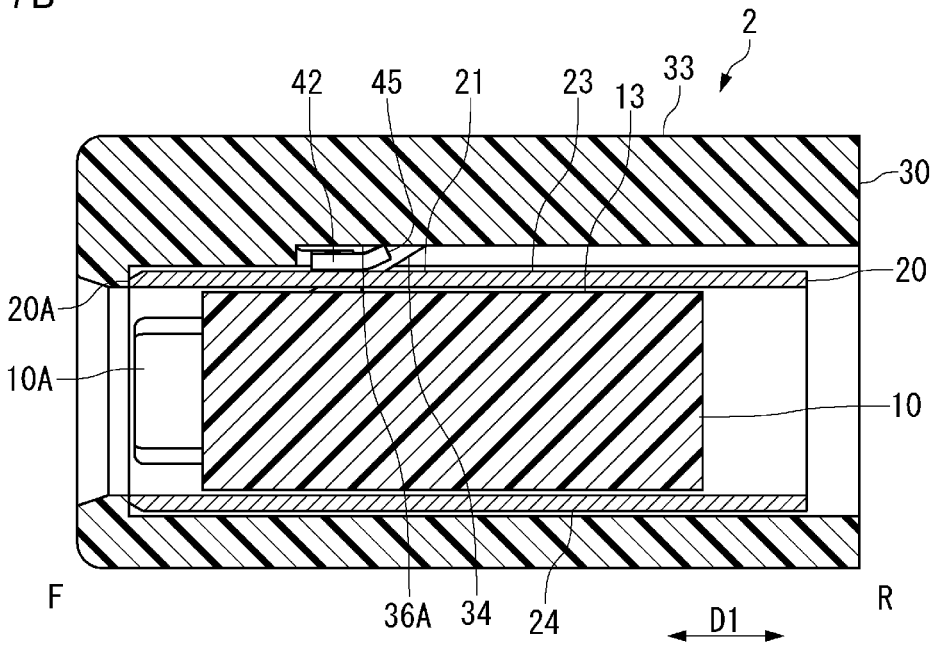
FIG. 7B is a sectional side view of the shielded connector taken along line VIIb-VIIb of FIG. 7A.

When the shield shell 20 is inserted into the outer housing 30 from the rear side, the cover tab 42 is guided in the axial-line direction D1 by the guide groove 36. As shown in FIGS. 6B and 7B, the pressed protrusion 45 comes into contact with the bottom portion 36A of the guide groove 36, which causes the free end portion of the cover tab 42 to be pressed between the outer housing 30 and the shell main body 21, so that the contact portion 22C of the cover tab 42 shown in FIG. 6B comes into contact with the shell main body 21 with a sufficient contact pressure. That is, the pressed protrusion 45 functions in a similar manner to the pressing protrusion 35 of the above embodiment.

In the connector 1, 2, the inner housing 10, the shield shell 20, and the outer housing 30 are configured to be rectangular in cross section, but in other embodiments, these may be configured to be circular in cross section. In that case, following the shape of the shell main body 21, the cover tab 22 is curved from the supported end portion to the contact portion, and extends along an outer wall of the shell main body 21, because this enables avoidance of electromagnetic noise emission from and/or entry into the cover tab 22. Further, in the connector 1, 2, the cover tab 22 extends in the direction of the width perpendicular to the axial-line direction D1, but in other embodiments, the cover tab 22 may extend in the axial-line direction D1.

The connector 1, 2 is applicable not only to on-board devices for vehicle but also to various other devices. As long as the connector 1, 2 is provided with a housing 10 retaining a contact and a shield shell 20 surrounding the housing 10 from the outside, and the shield shell 20 is provided with a cover tab 22 for covering an opening 210 formed in a shell main body 21 of the shield shell 20 while being set back from a catch protrusion 14A of the housing inserted into the opening 210 from the inside, the component can be selectively adopted or removed, and/or changed, if necessary. In another embodiment, the connector 1, 2 may not be provided with the outer housing 30 surrounding the shield shell 20 from the outside.

What is claimed is:

1. A shielded connector, comprising:

an inner housing accommodating a contact and having a catch protrusion; and a shield shell surrounding the inner housing and having a shell main body formed with an opening extending through the shield shell and a cover tab supported by the shell main body in a cantilever-like manner with a free end portion of the cover tab having a contact portion protruding toward the shell main body, the catch protrusion inserted from an inside of the shield shell into the opening and the cover tab covering the opening while being set back from the catch protrusion toward an outside of the shield shell.

2. The shielded connector of claim 1, wherein the free end portion of the cover tab has a pressed protrusion protruding from a portion of the cover tab covering the opening toward an outside of the shield shell.

3. The shielded connector of claim 2, wherein the pressed protrusion comes into contact with the outer housing, pressing the free end portion between the outer housing and the shell main body.

4. The shielded connector of claim 1, wherein the shell main body is formed in a tubular shape and has a seam along an axial-line direction.

5. The shielded connector of claim 4, wherein the cover tab is supported in a cantilever-like manner at either one of a first end portion and a second end portion of the shell main body, the first end portion and the second end portion of the shell main body are joined together at the seam.

6. The shielded connector of claim 5, wherein the cover tab extends in a direction perpendicular to the axial-line direction over the opening at the outside of the shield shell.

7. The shielded connector of claim 1, further comprising an outer housing surrounding the outside of the shield shell.

8. The shielded connector of claim 7, wherein the cover tab is held between the outer housing and the shell main body, and is pressed toward the shell main body by an apex portion of a pressing protrusion of the outer housing.

9. The shielded connector of claim 8, wherein the outer housing has a catch beam caught by the cover tab.

10. The shielded connector of claim 1, wherein the outer housing has a pressing protrusion protruding toward an inside of the outer housing and toward the free end portion of the cover tab.

11. The shielded connector of claim 10, wherein the free end portion of the cover tab is pressed between the pressing protrusion and the shell main body.

12. The shielded connector of claim 11, wherein the outer housing is formed with a guide groove capable of guiding the cover tab in a direction of insertion for the shield shell to be inserted into the outer housing.

13. The shielded connector of claim 12, wherein the cover tab extends in a direction perpendicular to the direction of insertion.

14. The shielded connector of claim 13, wherein the pressing protrusion and the catch beam caught by the cover tab are formed inside the guide groove.

15. The shielded connector of claim 14, wherein the catch beam is disposed nearer a supported end of the cover tab than the pressing protrusion.

* * * * *